US012410622B2

(12) United States Patent
Deere

(10) Patent No.: US 12,410,622 B2
(45) Date of Patent: Sep. 9, 2025

(54) FLOOR ROLLING APPARATUS

(71) Applicant: Melvin Deere, Melbourne, FL (US)

(72) Inventor: Melvin Deere, Melbourne, FL (US)

( * ) Notice: Subject to any disclaimer, the term of this patent is extended or adjusted under 35 U.S.C. 154(b) by 0 days.

(21) Appl. No.: 18/732,905

(22) Filed: Jun. 4, 2024

(65) Prior Publication Data

US 2024/0318438 A1 Sep. 26, 2024

(51) Int. Cl.
*E04F 21/20* (2006.01)

(52) U.S. Cl.
CPC ..... *E04F 21/20* (2013.01)

(58) Field of Classification Search
CPC ..... B30B 3/005; E04F 21/20; A01G 20/35; E01C 19/24; E01C 23/06
USPC ..... 280/32.5; 404/122, 131; 172/349, 350; 193/35, 37
See application file for complete search history.

(56) References Cited

U.S. PATENT DOCUMENTS 967,349 A * 8/1910 Dunham ..... A01B 29/02 172/350
1,174,698 A * 3/1916 Dunham ..... E01C 19/23 172/350
1,218,635 A * 3/1917 Dunham ..... E01C 19/238 404/129
1,855,108 A * 4/1932 Hoobler ..... B62B 1/12 280/47.27
1,924,644 A * 8/1933 Himmelberger ..... A01B 29/02 180/19.1
2,539,087 A * 1/1951 Kramer ..... B62B 5/06 401/208
3,119,314 A * 1/1964 Schiel, Jr. ..... E01C 19/236 172/554
4,314,395 A * 2/1982 Brock ..... E04F 21/22 D8/51
5,421,442 A * 6/1995 Agnoff ..... B65G 39/12 193/35 R
5,803,656 A * 9/1998 Turck ..... E01C 19/262 404/85
6,066,079 A * 5/2000 McDaniel ..... E04D 15/04 492/17
2005/0028941 A1* 2/2005 Flowers ..... E04F 21/20 156/574
2010/0319942 A1* 12/2010 Merkt ..... A01G 20/12 172/199

FOREIGN PATENT DOCUMENTS

KR 10-20009-0056565 * 6/2009

* cited by examiner

*Primary Examiner* — Christopher L Templeton
*Assistant Examiner* — P Derek Pressley
(74) *Attorney, Agent, or Firm* — Bullock Law; Stephen Bullock

(57) ABSTRACT

Embodiments of the present invention include a floor rolling apparatus including a pair of longitudinal support members with a respective pair of upper vaulted ends, an upper lateral support connecting from one longitudinal support member to the other, a lateral grip connecting from one longitudinal support member to the other, a lower reinforcement assembly, and a roller assembly with removably attached roller. The longitudinal support members include a first leveraging section and a second leveraging section that together with the upper lateral support are structured to leverage a user's weight, lower arms and upper arms to facilitate rolling the apparatus roller on a floor.

20 Claims, 7 Drawing Sheets

FLOOR ROLLING APPARATUS

FIELD OF THE INVENTION

The present invention relates to rolling tools for flooring. In particular, the present invention relates to a floor rolling apparatus and associated methods.

BACKGROUND

Laying floors is an arduous task that can be strenuous on a person's body. Oftentimes flooring such as vinyl must be rolled after it has been applied in order to ensure it is flat. Other rollers in the art do not leverage a person's arms and weight to ease the user's body strain.

There exists a need in the art for a floor roller that leverages a person's own body and weight to facilitate the floor rolling process. Therefore, there exists a need in the art for a floor rolling apparatus as claimed and described herein.

SUMMARY OF THE INVENTION

Embodiments of the present invention are related a floor rolling apparatus with a pair of longitudinal support members, an upper lateral support connecting from one longitudinal support member to the other, a lateral grip connecting from one longitudinal support member to the other, a lower reinforcement assembly, and a roller assembly with removably attached roller. The longitudinal support members may include a respective pair of upper vaulted ends and the lower reinforcement assembly may include an L-bracket. The L-bracket may include an L-bracket bottom, an L-bracket side, and an angled support member. The angled support member may extend from the L-bracket bottom to the L-bracket side. Additionally, the roller assembly may include a roller brace structured to fit a removable roller therein. There may be a lower extension structured to fit the roller assembly between the pair of longitudinal support members and the roller assembly may include a roller with a pair of opposing compressible attachment knobs structured to removably attach the roller within a pair of knob holes on opposing sides of the L-bracket. Furthermore, the upper lateral support may be positioned on an upper portion of the apparatus and the lateral grip may be positioned medially on the apparatus.

Another embodiment of the invention may include a floor rolling apparatus including a pair of longitudinal support members with a respective pair of upper vaulted ends, an upper lateral support connecting from one longitudinal support member to the other, a lateral grip connecting from one longitudinal support member to the other, a lower reinforcement assembly, and a roller assembly with removably attached roller. The longitudinal support members may include a first leveraging section and a second leveraging section that together with the upper lateral support may be structured to leverage a user's weight, lower arms and upper arms to facilitate rolling the apparatus roller on a floor.

In this embodiment, the vaulted ends may be structured to rock along a user's upper arms when the roller is being used and may be angled on at least two sides of the longitudinal support members allowing the apparatus to be reversible. The longitudinal support members may include a fitting notch at one respective end allowing respective compressible attachment knobs to rest therewithin when the roller is attached. The longitudinal support members may be structured to be spaced apart by a length equivalent to an average user's shoulder width. A lower extension may be structured to fit the roller assembly between the pair of longitudinal support members. Additionally, the roller assembly may be attached to the lower reinforcement assembly via fasteners fitting through adjustable fitting holes within the roller assembly. The lower reinforcement assembly may include an L-bracket with an angled support member.

Yet another embodiment of the invention may include a floor rolling apparatus with a pair of longitudinal support members including a respective pair of upper vaulted ends, an upper lateral support connecting from one longitudinal support member to the other, a medially positioned lateral grip connecting from one longitudinal support member to the other, a lower reinforcement assembly, a roller assembly with removably attached roller, and a lower extension structured to fit the roller assembly between the pair of longitudinal support members. The longitudinal support members may be structured to be spaced apart by a length equivalent to shoulder width and may include a first leveraging section and a second leveraging section that together with the upper lateral support may be structured to leverage a user's weight, lower arms and upper arms to facilitate rolling the apparatus roller on a floor. The lateral grip may be positioned medially on the apparatus and the upper lateral support may be positioned on an upper portion of the apparatus.

DETAILED DESCRIPTION OF THE INVENTION

The present invention will now be described in detail with reference to the accompanying drawings. The embodiment descriptions are illustrative and not intended to be limiting in any way. Other embodiments of the invention will readily suggest themselves to persons with ordinary skill in the art after having the benefit of this disclosure. Accordingly, the following embodiments are set forth without any loss of generality and without imposing limitation upon the claimed invention.

Directional terms such as "above" "below" "upper" "lower" and other like terms are used for the convenience of the reader in reference to the drawings. Additionally, the description may contain terminology to convey position, orientation, and direction without departing from the principles of the present invention. Such positional language should be taken in context of the represented drawings.

Quantitative terms such as "generally" "substantially" "mostly" and other like terms are used to mean that the referred object, characteristic, or quality constitutes a majority of the referenced subject. Likewise, use of the terms such as first and second do not necessarily designate a limitation of quantity. Such terms may be used as a method of describing the presence of at least one of the referenced elements or may provide a means of differentiating orientation. The meaning of any term within this description is dependent upon the context within which it is used, and the meaning may be expressly modified.

Figure 1:
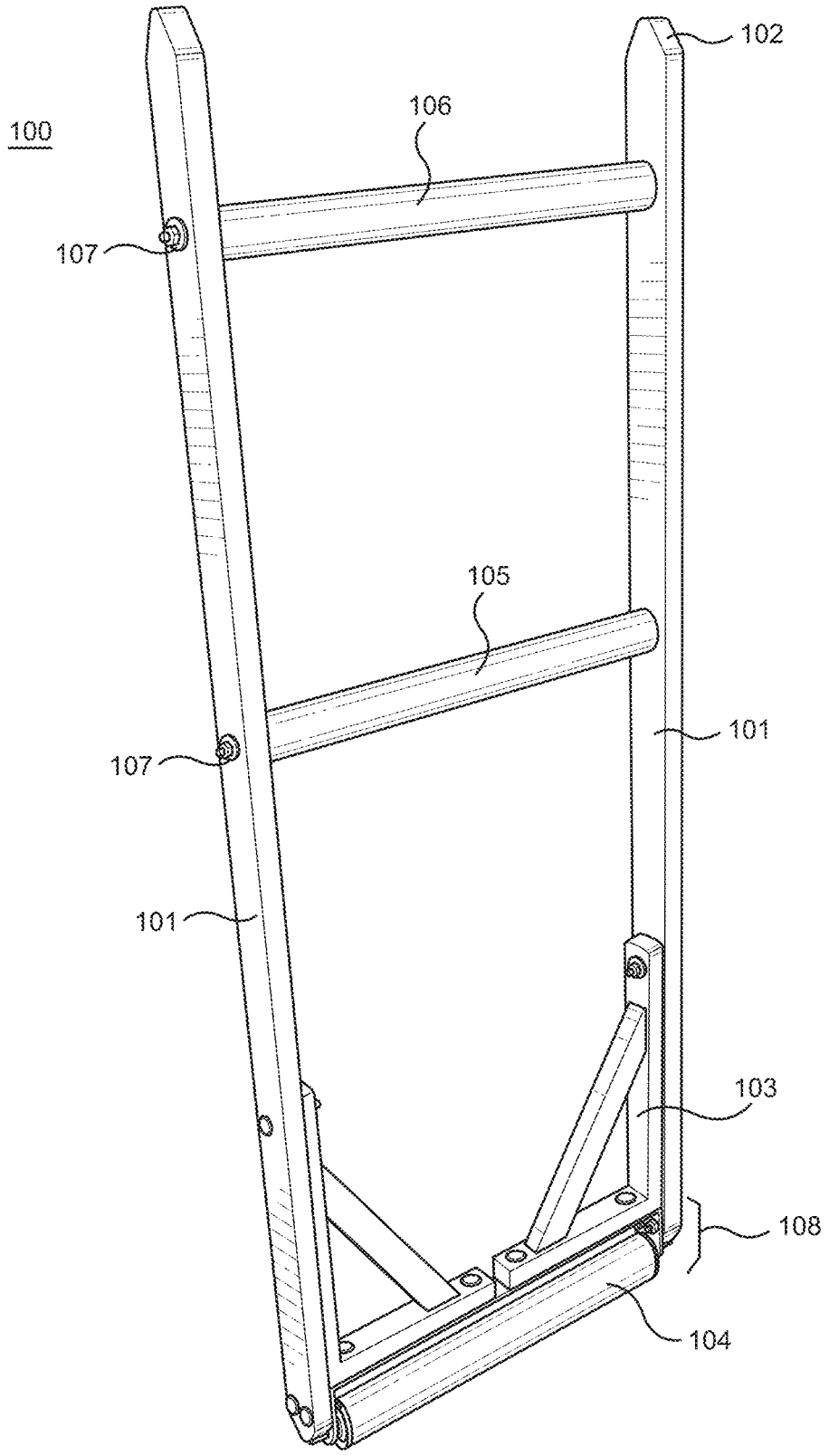
FIG. 1 is a perspective view of the floor rolling apparatus according to an embodiment of the invention.

Referring now to FIG. 1, the floor rolling apparatus 100, hereinafter apparatus 100, will be described more fully. The apparatus 100 may include a pair of side longitudinal supports 101 with upper vaulted ends 102 at one end. In some embodiments, the side longitudinal supports 101 may be spaced apart by a length equivalent to an average person's shoulder width.

Positioned at a lower end may be a lower reinforcement assembly 103 structured to connect with and reinforce a roller assembly 108 that holds a roller 104. The roller assembly 108 may be positioned between the pair of side longitudinal support members 101 at a lower end of the apparatus 100. Further positioned between each side longitudinal support 101 and connecting from one side longitudinal support 101 to the other may be a lateral grip 105 and an upper lateral support 106. The upper lateral support 106 may be positioned on an upper portion of the apparatus 100 and the lateral grip 105 may be positioned medially on the apparatus 100. Each may be connected to the side longitudinal supports 101 via fasteners 107, which may be nut and bolt combinations.

Figure 2:
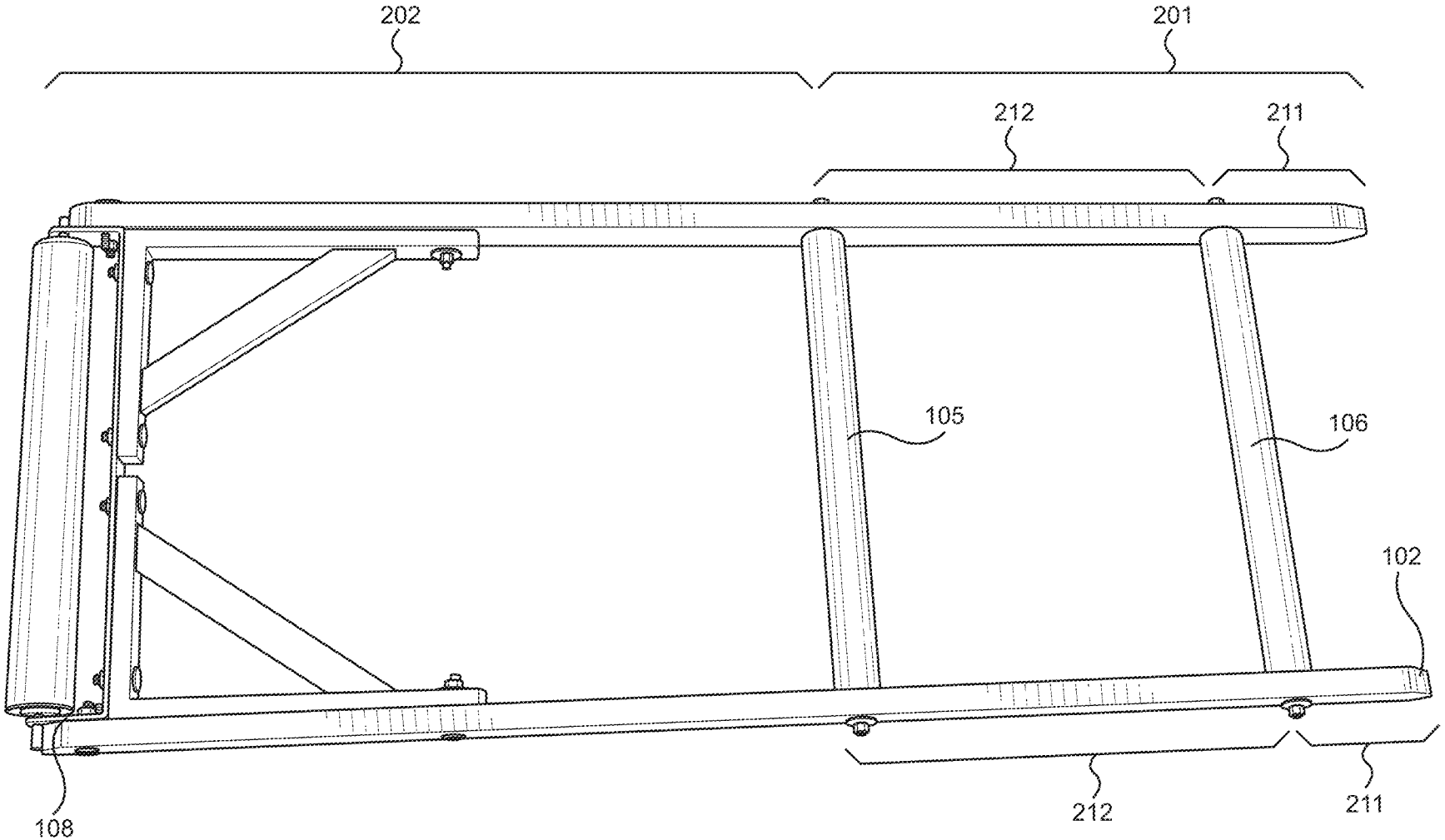
FIG. 2 is a front perspective view of the floor rolling apparatus according to an embodiment of the invention illustrated in FIG. 1.
Figure 3:
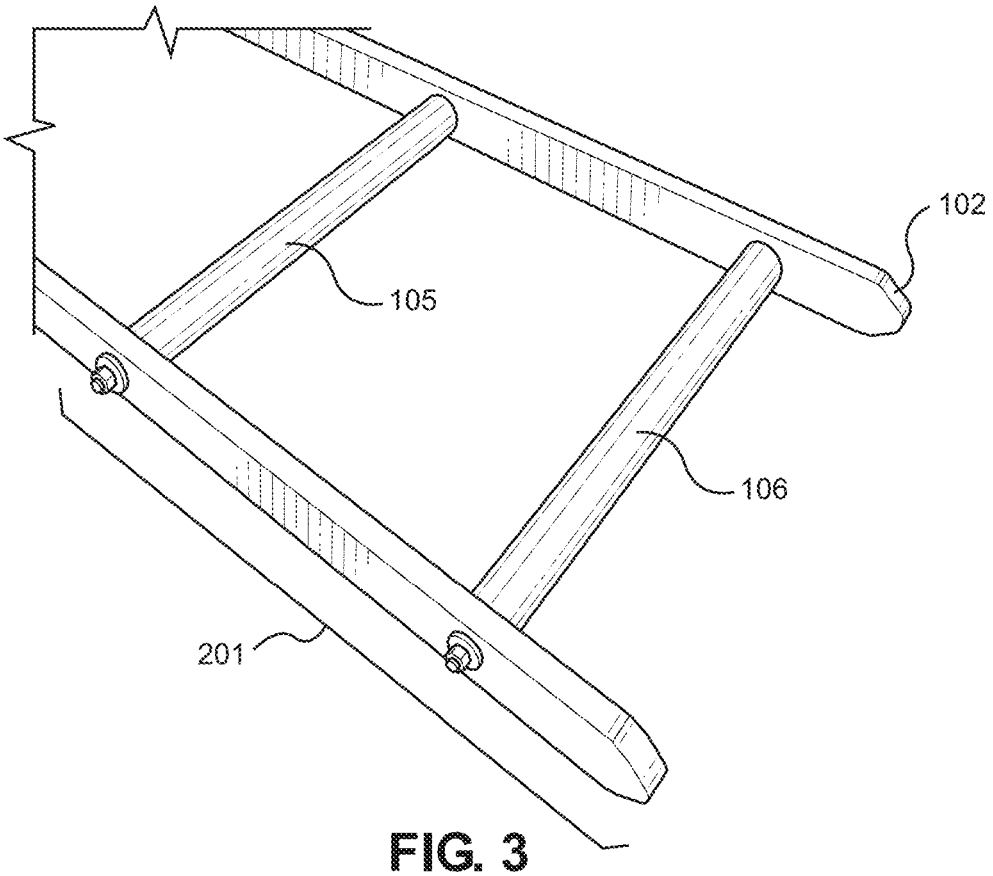
FIG. 3 is a segmented top half view of the floor rolling apparatus illustrated in FIG. 1.
Figure 4:
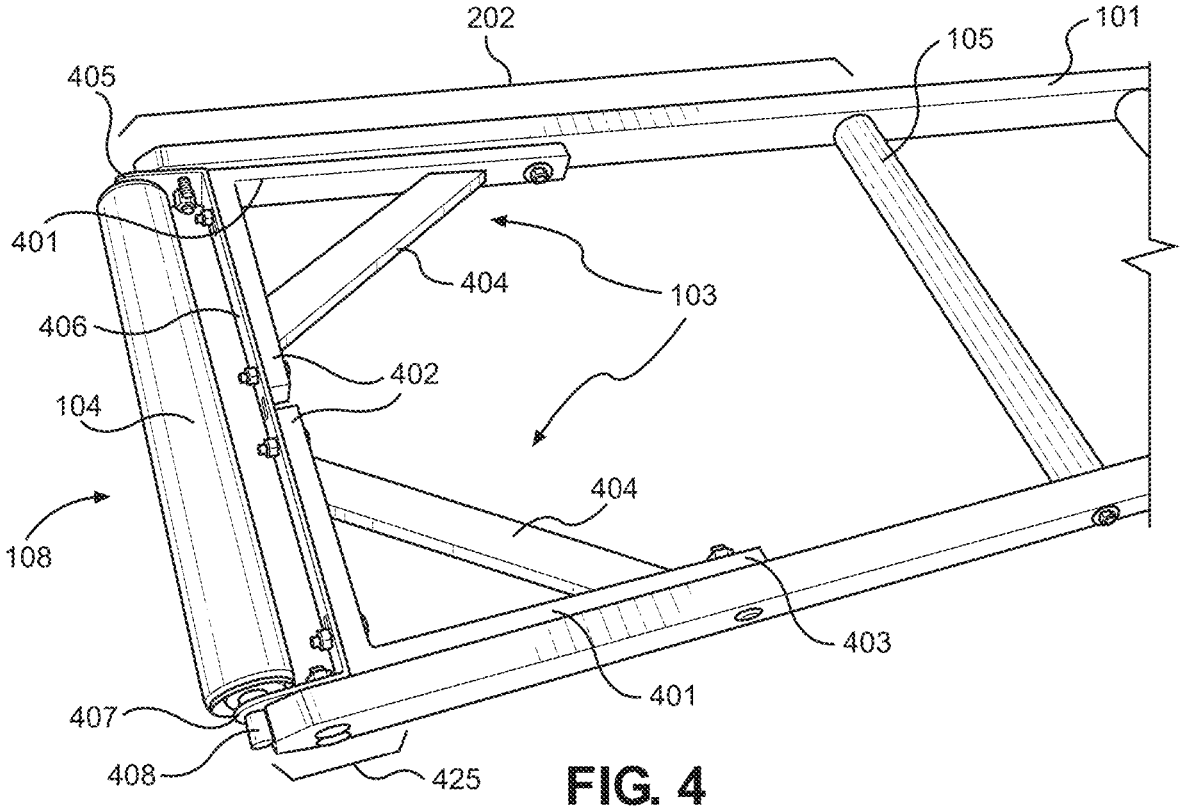
FIG. 4 is a segmented bottom half view of the floor rolling apparatus illustrated in FIG. 1.

FIGS. 2, 3 and 4 show how the apparatus 100 may be viewed as an upper segment 201 and a lower segment 202. The upper segment 201 may range from the upper vaulted ends 102 to the lateral grip 105 and the lower segment 202 may range from the lateral grip 105 to the roller assembly 108.

Furthermore, the upper segment 201 may include a first leveraging section 211 and a second leveraging section 212. The first leveraging section may range from the upper vaulted ends 102 to the upper lateral support 106 and the second leveraging section 212 may range from the upper lateral support 106 to the lateral grip 105.

FIG. 3 shows how the vaulted ends 102 may include two angled sides culminating into a rounded vertex allowing the apparatus 100 to be reversible. As will be shown hereinafter, the vaulted ends 102 facilitate the apparatus' 100 use since the angled sides allow for the device to rock along a user's upper arm without having an end corner awkwardly thrusting into their upper arm.

FIG. 4 takes a closer look at the lower segment 202, which includes the lower reinforcement assembly 103 and the roller assembly 108. The lower reinforcement assembly 103 may include a pair of L-brackets 401. The L-brackets 401 may include L-bracket bottoms 402, L-bracket sides 403, and angled support members 404. The L-bracket sides 403 may be affixed to an interior of each respective side longitudinal support 101. The L-bracket bottoms 402 may provide a lateral support for the lower reinforcement assembly 103 to attach. Furthermore, the angled support members 404 may extend from the L-bracket bottoms 402 to the L-bracket sides 403 and may assist with distributing the weight and force applied to the apparatus 100 when in use as well as assist with maintaining the integrity of the lower segment 202 of the apparatus 100.

The roller assembly 108 may fit within a lower extension housing 425. This may be an extension of the side longitudinal supports 101 structured to fit a roller brace 405 therein. The roller brace 405 may have a brace foundation 406 and a brace side 407. Additionally, the roller 104 may removably attach at opposite ends to the brace sides 407 via compressible attachment knobs 408.

Figure 5:
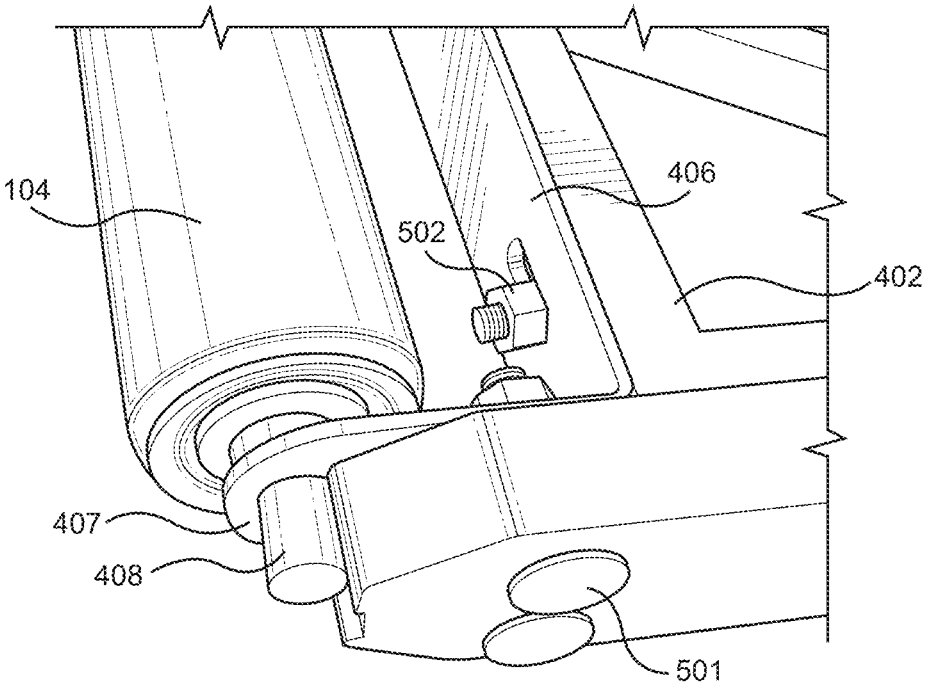
FIG. 5 is a segmented bottom portion view of the floor rolling apparatus illustrated in FIG. 1.
Figure 6:
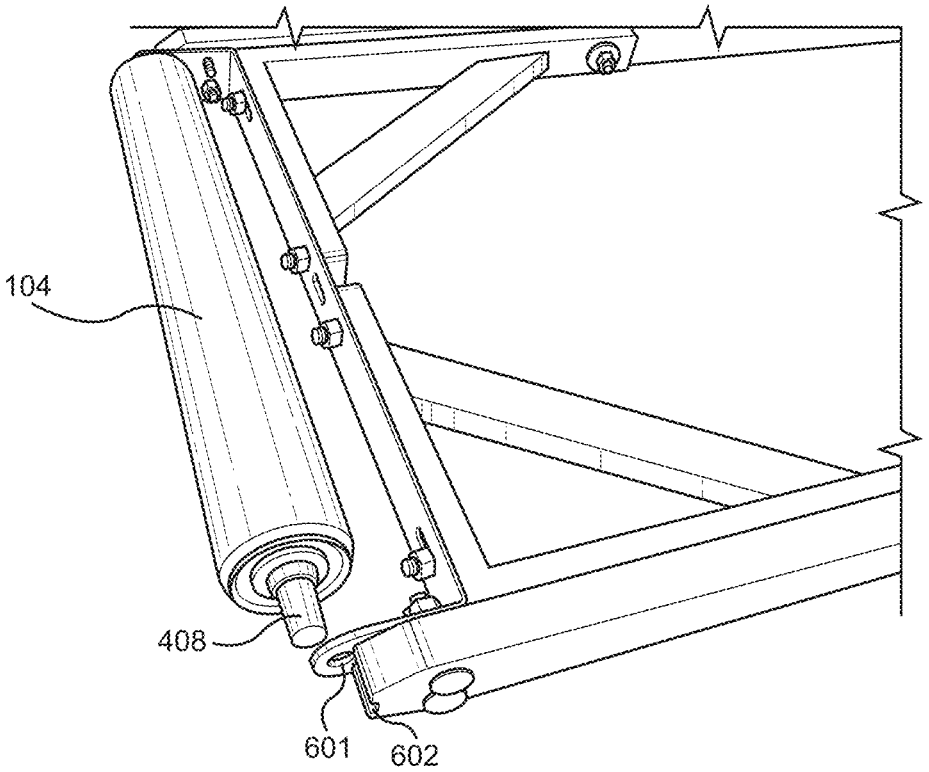
FIG. 6 is a segmented bottom portion view of the floor rolling apparatus illustrated in FIG. 1.

FIGS. 5 and 6 take a closer look at the lower segment 202. As shown specifically in FIG. 5, the brace foundation 406 may secure to the L-bracket bottoms 402 via brace fasteners 502. In some embodiments, this may be a nut and bolt fastener. Furthermore, the brace sides 407 may be secured to the side longitudinal support 101 within the lower extension housing 425 via L-bracket fasteners 501.

FIG. 6 illustrates that the roller 104 may be removably detached from the L-bracket 402. This is because the compressible attachment knob 408 may fit within a knob hole 601 within the brace side 407. Furthermore, the compressible attachment knobs 408 in the attached state may bias within fitting notches 602 embedded within respective ends of the side longitudinal supports 101 after they have permeated the knob hole 601. But, when the compressible attachment knob 408 is compressed and the roller 104 pulled, it may remove from the roller brace 405.

Figure 7:
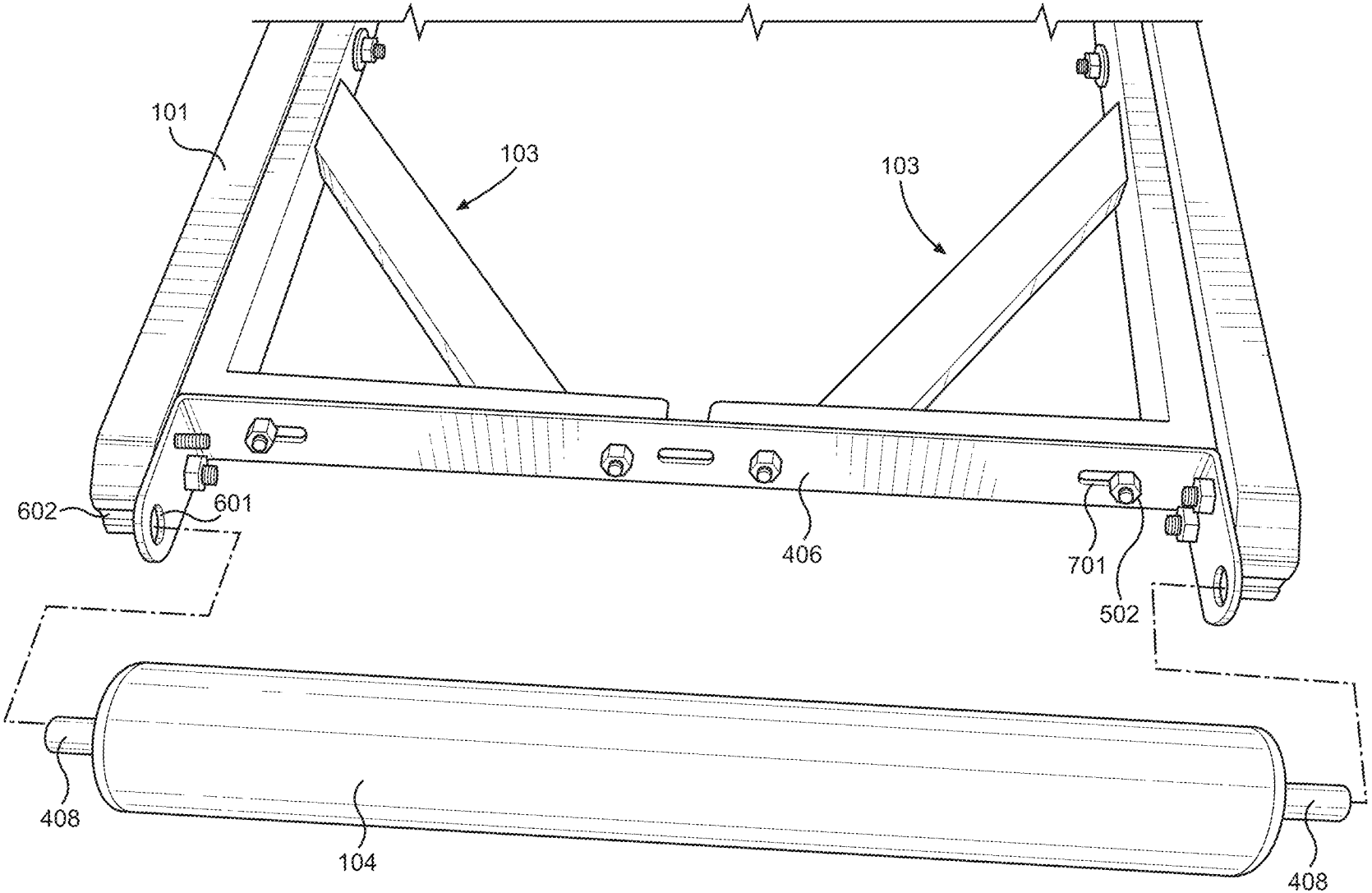
FIG. 7 is a segmented bottom view of the floor rolling apparatus illustrated in FIG. 1 with detached roller.

FIG. 7 shows a completely detached roller 104, but illustrates where the compressible knobs 408 may fit within the knob holes 601 and fitting notches 602. Furthermore, the brace fasteners 502 may fit within adjustable fitting holes 701 on the brace foundation 406. So, the roller assembly 108 may be attached to the lower reinforcement assembly 103 via fasteners 502 fitting through adjustable fitting holes 701 within the roller assembly 108. Also shown, is how the brace sides 407 extend past the respective ends of the side longitudinal supports 101 so that the compressible knobs 408 may rest within the fitting notches 602 of each end of the side longitudinal supports 101.

Figure 8:
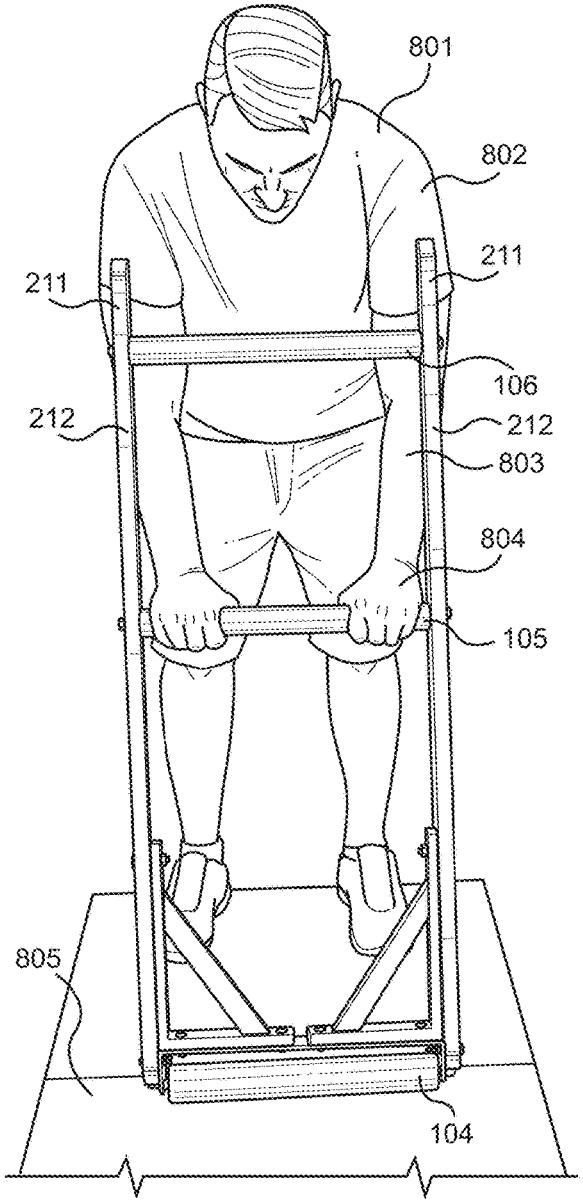
FIG. 8 is a demonstrative environmental front view of the floor rolling apparatus illustrated in FIG. 1.
Figure 9:
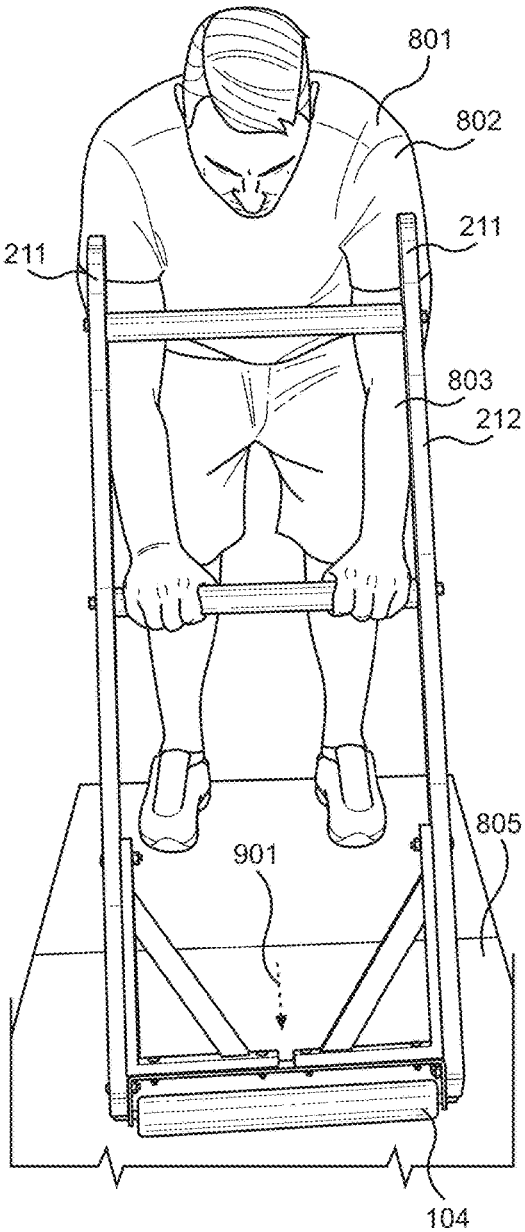
FIG. 9 is a demonstrative environmental front view of the floor rolling apparatus illustrated in FIG. 1.

FIGS. 8 and 9 show a front environmental view of how the apparatus 100 may be used. Referring to FIG. 8, a user 801 may grasp the lateral grip 105 with both hands 804 while the lateral support 106 is abutting perpendicularly the user's 801 upper arm 802. The first leveraging section 211 may abut the user's upper arm 802 longitudinally. The roller 104 is on the floor 805 and the user 801 is in a generally upright stance.

FIG. 9 shows the user 801 bent over using their body weight to extend the apparatus 901 outward rolling the roller 104 away from their body. The lateral support 106 along with the first leveraging section 211 press against the user's upper arms 802 while the user 801 is leaning into the lateral grip 105 to roll the apparatus 100 outward on the floor 104. Therefore, the apparatus 100 is using bodyweight, leverage, and momentum to do the rolling work while the user 801 is simultaneously being supported by the apparatus 100.

Figure 10:
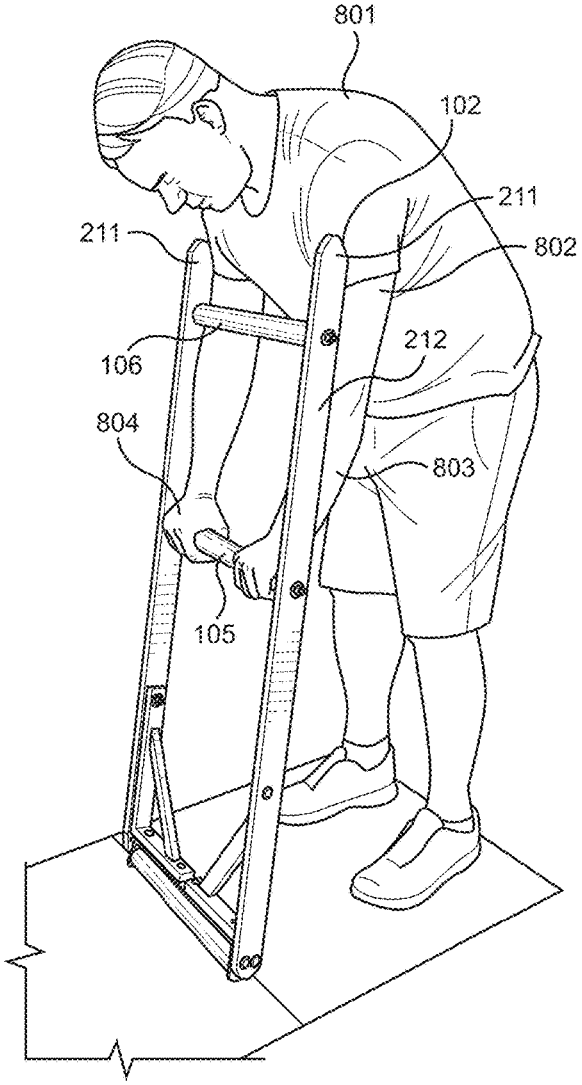
FIG. 10 is a demonstrative environmental side perspective view of the floor rolling apparatus illustrated in FIG. 1.
Figure 11:
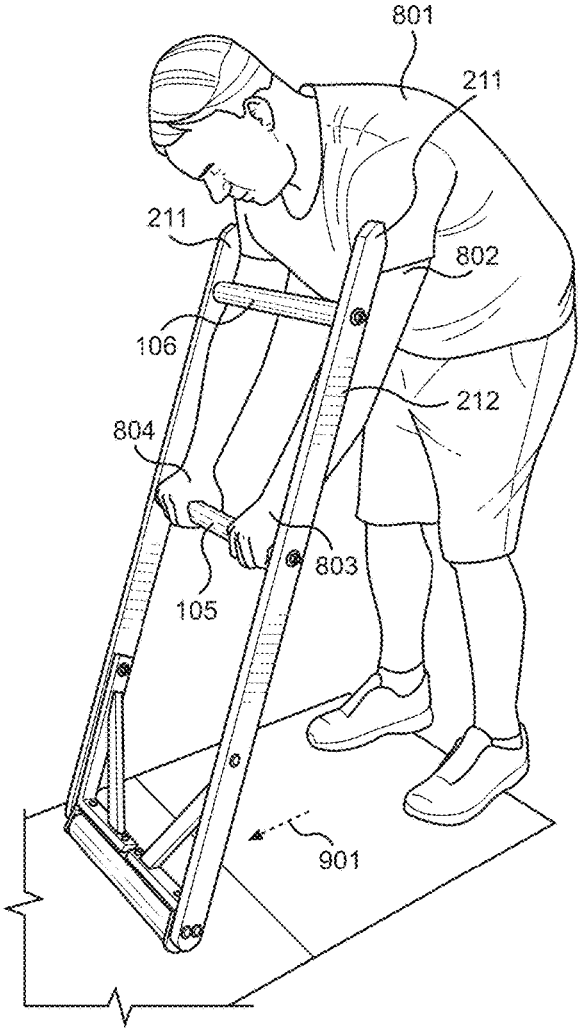
FIG. 11 is a demonstrative environmental side perspective view of the floor rolling apparatus illustrated in FIG. 1.

FIGS. 10 and 11 are side environmental views of how the apparatus 100 may be used. FIG. 10 shows again that the user 801 may grasp the lateral grip 105 with both hands 804 while the lateral support 106 is abutting perpendicularly the user's 801 upper arm 802. The first leveraging section 211 may abut the user's upper arm 802 longitudinally. The roller 104 is on the floor 805 and the user 801 is in a generally upright stance. The second leveraging section is abutting the user's forearm 803.

FIG. 11 shows the user 801 bent over using their body weight to extend the apparatus 901 outward rolling the roller 104 away from their body. The lateral support 106 along with the first leveraging section 211 press against the user's upper arms 802 while the user 801 is leaning into the lateral grip 105 to roll the apparatus 100 outward on the floor 104. The second leveraging section 212 is using the user's forearms 803 for added leverage. The apparatus 100 is using bodyweight, leverage, and momentum to do the rolling work while the user 801 is simultaneously being supported by the apparatus 100. Stated differently, the longitudinal support members 101 may include a first leveraging section 211 and a second leveraging section 212 that together with the upper lateral support 106 and lateral grip 105 are structured to leverage a user's weight, lower arms 803 and upper arms 802 to facilitate rolling the apparatus roller 100 on the floor 805.

Furthermore, this angle shows that the vaulted ends 102 prevent the ends of the side longitudinal supports 101 from awkwardly thrusting into the user's 801 upper arms. They instead rock along a user's upper arms 802 when the roller 104 is being used. Additionally, the vaulted ends 102 may be angled on at least two sides of the longitudinal support members 101 allowing the apparatus 100 to be reversible.

That which is claimed is:

1. A floor rolling apparatus comprising:
- a pair of parallel longitudinal support members with a respective pair of upper vaulted ends;
- a first leveraging section and a second leveraging section;
- an upper lateral support connecting from one longitudinal support member to the other;
- a lateral grip connecting from one longitudinal support member to the other;
- a lower reinforcement assembly; and
- a roller assembly with removably attached roller;
- wherein the lateral grip is perpendicular to the parallel longitudinal support members and configured as a user's hand grip;
- wherein the first leveraging section ranges from the upper vaulted ends to the upper lateral support and the second leveraging section ranges from the upper lateral support to the lateral grip; and
- wherein the parallel longitudinal support members are parallel from the roller assembly to the vaulted ends;
- wherein the roller is positioned between each respective parallel longitudinal support member;
- wherein the lateral grip is positioned below the upper lateral support and the first leveraging section;
- wherein the first leveraging section of each parallel longitudinal support member comprises a straight extension configured to leverage against a user's upper arm; and
- wherein the floor rolling apparatus is symmetric from the front, back, and sides and configured as reversible.

2. The floor rolling apparatus of claim 1 wherein opposing ends of the upper lateral support are terminated by the longitudinal support members and the longitudinal support members extend straight and distally from the lateral support members toward an upper end of the floor rolling apparatus before tapering into the vaulted ends.

3. The floor rolling apparatus of claim 1 wherein the lower reinforcement assembly comprises an L-bracket.

4. The floor rolling apparatus of claim 3 wherein the L-bracket includes an L-bracket bottom, an L-bracket side, and an angled support member.

5. The floor rolling apparatus of claim 4 wherein the angled support member extends from the L-bracket bottom to the L-bracket side.

6. The floor rolling apparatus of claim 1 wherein the roller assembly includes a roller brace configured to fit a removable roller therein.

7. The floor rolling apparatus of claim 1 further including a lower extension configured to fit the roller assembly between the pair of longitudinal support members.

8. The floor rolling apparatus of claim 1 wherein the roller assembly comprises a roller with a pair of opposing compressible attachment knobs configured to removably attach the roller within a pair of knob holes on opposing sides of an L-bracket.

9. The floor rolling apparatus of claim 1 wherein the upper lateral support is positioned on an upper portion of the apparatus and the lateral grip is positioned medially on the apparatus.

10. A floor rolling apparatus comprising:
- a pair of parallel longitudinal support members with a respective pair of upper vaulted ends;
- an upper lateral support connecting from one longitudinal support member to the other;
- a lateral grip connecting from one longitudinal support member to the other;
- a lower reinforcement assembly; and
- a roller assembly with removably attached roller;
- wherein the upper lateral support is perpendicular to the parallel longitudinal support members and configured as a user's hand grip;
- wherein the parallel longitudinal support members are parallel from the roller assembly to the vaulted ends;
- wherein the roller is positioned between each respective parallel longitudinal support member;
- wherein the lateral grip is positioned below the upper lateral support and the first leveraging section;
- wherein the longitudinal support members include a first leveraging section and a second leveraging section that together with the upper lateral support are configured to leverage a user's weight, lower arms and upper arms to facilitate rolling the apparatus roller on a floor; and
- wherein the floor rolling apparatus is symmetric from the front, back, and sides and configured as reversible.

11. The floor rolling apparatus of claim 10 wherein the vaulted ends are configured to rock along a user's upper arms when the roller is being used.

12. The floor rolling apparatus of claim 10 wherein the vaulted ends are angled on at least two sides of the longitudinal support members allowing the apparatus to be reversible.

13. The floor rolling apparatus of claim 10 wherein the longitudinal support members include a fitting notch at one respective end allowing respective compressible attachment knobs to rest therewithin when the roller is attached.

14. The floor rolling apparatus of claim 10 wherein the longitudinal support members are configured to be spaced apart by a length equivalent to a user's shoulder width.

15. The floor rolling apparatus of claim 10 further including a lower extension configured to fit the roller assembly between the pair of longitudinal support members.

16. The floor rolling apparatus of claim 10 wherein the roller assembly is attached to the lower reinforcement assembly via fasteners fitting through adjustable fitting holes within the roller assembly.

17. The floor rolling apparatus of claim 10 wherein the lower reinforcement assembly includes an L-bracket with an angled support member.

18. A floor rolling apparatus comprising:
- a pair of parallel longitudinal support members with a respective pair of upper vaulted ends;

an upper lateral support connecting from one longitudinal support member to the other;

a medially positioned lateral grip connecting from one longitudinal support member to the other;

a lower reinforcement assembly; and a roller assembly with removably attached roller;

a lower extension configured to fit the roller assembly between the pair of longitudinal support members;

wherein the upper lateral support is perpendicular to the parallel longitudinal support members and configured as a user's hand grip;

wherein the parallel longitudinal support members are configured to be spaced apart by a length equivalent to shoulder width;

wherein the parallel longitudinal support members are parallel from the roller assembly to the vaulted ends;

wherein the roller is positioned between each respective parallel longitudinal support member;

wherein the lateral grip is positioned below the upper lateral support and the first leveraging section;

wherein the parallel longitudinal support members include a first leveraging section and a second leveraging section that together with the upper lateral support are configured to leverage a user's weight, lower arms and upper arms to facilitate rolling the apparatus roller on a floor; and wherein the floor rolling apparatus is symmetric from the front, back, and sides and configured as reversible.

19. The floor rolling apparatus of claim 18 wherein opposing ends of the upper lateral support are terminated by the longitudinal support members and the longitudinal support members extend straight and distally from the lateral support members toward an upper end of the floor rolling apparatus before tapering into the vaulted ends.

20. The floor rolling apparatus of claim 18 wherein the upper lateral support is positioned on an upper portion of the apparatus.

* * * * *